US006715539B2

(12) United States Patent
Bianco

(10) Patent No.: US 6,715,539 B2
(45) Date of Patent: Apr. 6, 2004

(54) HEAT EXCHANGER AND AIRFLOW THERETHROUGH

(76) Inventor: Michael Bianco, 135 Pembroke Dr., Palm Beach Gardens, FL (US) 33418

( * ) Notice: Subject to any disclaimer, the term of this patent is extended or adjusted under 35 U.S.C. 154(b) by 0 days.

(21) Appl. No.: 10/078,242

(22) Filed: Feb. 19, 2002

(65) Prior Publication Data

US 2003/0155107 A1 Aug. 21, 2003

(51) Int. Cl.[7] ..... F28F 13/06; F25B 39/02

(52) U.S. Cl. ..... 165/122; 165/127; 165/47; 165/163; 165/124; 62/516

(58) Field of Search ..... 165/122, 124, 165/121, 65, 127, 47, 164, 163; 62/516, 517, 519, 525

(56) References Cited

U.S. PATENT DOCUMENTS

| | | | | |
|---|---|---|---|---|
| 1,913,742 A | | 6/1933 | Bates | |
| 3,200,609 A | | 8/1965 | Laing | |
| 3,596,475 A | * | 8/1971 | Berger | 62/286 |
| 3,628,590 A | * | 12/1971 | Knebusch | 165/122 |
| 3,678,993 A | * | 7/1972 | Pierce | 165/76 |
| 3,823,768 A | * | 7/1974 | Finger | 165/122 |
| 3,834,451 A | * | 9/1974 | Kozinski | 165/43 |
| 4,726,197 A | * | 2/1988 | Megrditchian | 62/309 |
| 4,824,685 A | | 4/1989 | Bianco | |
| 4,874,040 A | * | 10/1989 | Herrmann | 165/122 |
| 5,335,721 A | | 8/1994 | Wollaber et al. | |
| 5,373,780 A | | 12/1994 | Bianco | |
| 5,402,656 A | | 4/1995 | Jaster et al. | |
| 5,789,007 A | | 8/1998 | Bianco | |
| 5,881,567 A | | 3/1999 | Junge et al. | |
| 5,918,666 A | | 7/1999 | Chin | |
| 5,965,185 A | | 10/1999 | Bianco | |
| 6,196,302 B1 | | 3/2001 | Chuang | |
| 6,227,002 B1 | | 5/2001 | Bianco et al. | |

FOREIGN PATENT DOCUMENTS

DE 1527918 B * 4/1977

* cited by examiner

*Primary Examiner*—Henry Bennett
*Assistant Examiner*—Tho V Duong
(74) *Attorney, Agent, or Firm*—Kenyon & Kenyon

(57) ABSTRACT

A heat exchanger defining a path of multi-directional airflow therethrough. A coil assembly within a housing of the heat exchanger divides the interior of the housing into first and second airflow plenums. The path of airflow includes a first portion in a first direction defining a cross flow distributed over a portion of the coil assembly in the first airflow plenum. A second portion defines a flow extending from the first airflow plenum in a second direction through the coil assembly. A third portion in the first direction defines a second cross flow distributed over a portion of the coil assembly in the second airflow plenum. In one embodiment, the coil assembly is oriented in an angular manner within the housing of the heat exchanger.

22 Claims, 4 Drawing Sheets

HEAT EXCHANGER AND AIRFLOW THERETHROUGH

TECHNICAL FIELD

The present invention relates to heat exchangers and, more particularly, relates to the flow of air therethrough.

BACKGROUND OF THE INVENTION

The vapor compression refrigeration cycle is the pattern cycle for a majority of the commercially available refrigeration systems. This thermal transfer cycle is typically accomplished by a compressor, condenser, throttling device and evaporator connected in serial fluid communication with one another. The system is charged with refrigerant which circulates through each of the components to remove heat from the evaporator and transfer heat to the condenser. Thus, the evaporator and condenser are commonly referred to as heat exchangers.

There is a wide variety of heat exchangers available today. However, the shape and size of the heat exchangers often depends on how the refrigeration cycle is to be used as well as the type of refrigerant to be used. For example, the space where the refrigeration system is to be placed is often limited in size and there are often restraints on the available airflow. Also, the performance of the refrigeration system often limits the types of refrigeration systems which would be acceptable for a particular application.

Therefore, there is a need for a low profile heat exchanger which may be used in an economy of space. The new heat exchanger must also maximize the airflow therethrough to provide a more efficient heat exchange.

SUMMARY OF THE INVENTION

The present invention solves the above-identified problems by providing a low profile heat exchanger which provides a path of multi-directional airflow within the interior of the heat exchanger to provide more efficient heat exchange.

Generally described, the heat exchanger of the present invention includes a housing divided into first and second airflow plenums by a coil assembly. The airflow plenums are used to create a more desirable path of airflow. The path of airflow through the housing includes a first portion in a first direction in the first airflow plenum. The first portion of the airflow path defines a cross flow distributed over a portion of the coil assembly. A second portion of the path of airflow defines a flow in a second direction extending from the first airflow plenum, through the coil assembly, and down to the second airflow plenum. A third portion of the airflow path in the first direction defines a second cross flow distributed over a portion of the coil assembly in the second airflow plenum.

According to one aspect of the invention, the coil assembly is oriented in an angular manner within the housing of the heat exchanger. When the coil assembly is mounted in an angular manner within the housing, the cross-sectional area of the first airflow plenum diminishes as the air flow is distributed in the first airflow plenum. Also, the cross-sectional area of the second airflow plenum increases as the airflow is distributed over the coil assembly toward an outlet in the housing.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

FIG. 1 also illustrates a portion of one of the evaporators cut away to show a portion of the elongated segments of the coil assembly.

DETAILED DESCRIPTION

Figure 1:
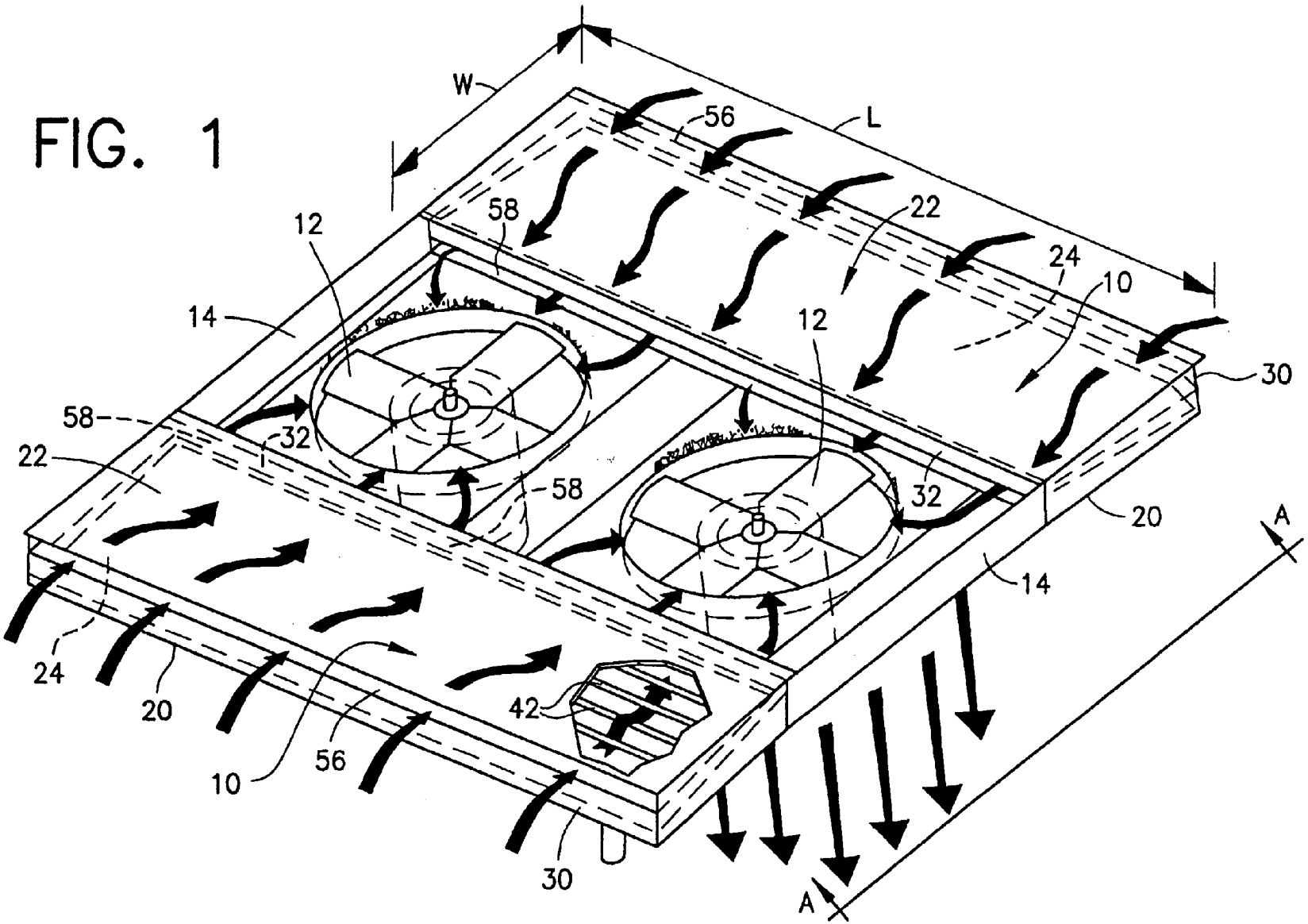
FIG. 1 illustrates a perspective view of a pair of evaporators utilized in combination with a pair of air movers.

Referring now to the drawings in which like numerals indicate like elements throughout the several views, FIG. 1 illustrates an exemplary embodiment of a refrigeration system utilizing one embodiment of evaporators 10 of the present invention. While a particular embodiment of the present invention may be described with reference to a particular heat exchanger application such as an evaporator 10, it is understood that the present invention may also be adapted for use in a condenser or in a variety of other applications requiring heat transfer.

Figure 2:
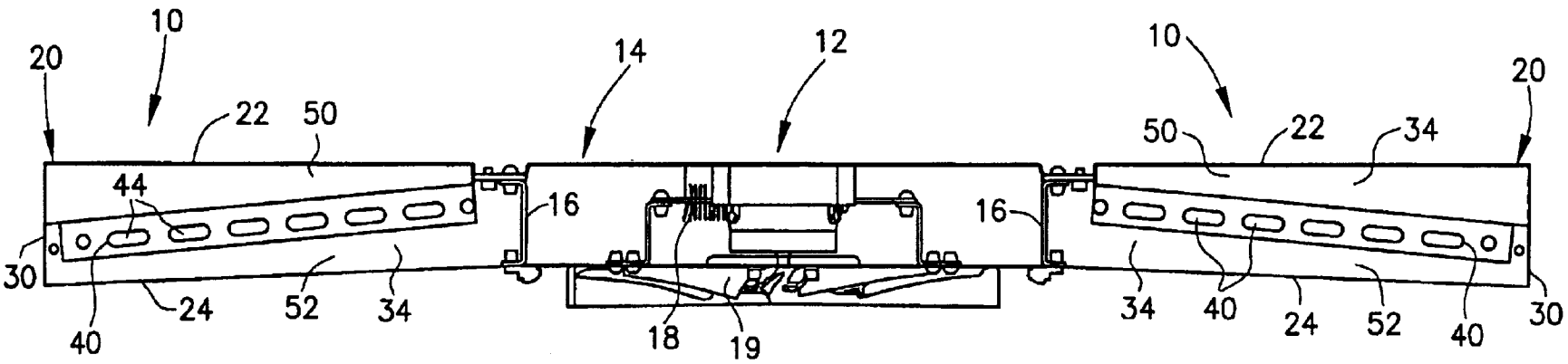
FIG. 2 illustrates a side view of the evaporators and air movers taken along line A—A of FIG. 1.

In one embodiment of the present invention, as best shown in FIG. 1, a pair of evaporators 10 is positioned on opposite sides of a pair of adjacent air movers 12. Each of the air movers 12 has a housing 14 mechanically coupled to a housing 20 of each evaporator 10. Fasteners such as metal strap members 16 may be used to couple the evaporators 10 to the housings 14 of the air movers 12 as shown in FIG. 2. FIG. 2 also illustrates a heater 18 on at least one of the air movers 12 for heating the airflow before the airflow passes through fan blades 19. Although this particular embodiment includes a pair of air movers 12 in combination with a pair of evaporators 10, it is within the scope of the present invention to include any number of air movers 12 with any number of evaporators 10. Also, the orientation of the air movers 12 relative the evaporators 10 is preferably such that the axis of rotation of the air movers 12 is substantially perpendicular to the general direction of the airflow through the evaporators 10. Moreover, the air movers 12 are preferably oriented relative to the evaporators 10 such that the airflow is first drawn through the evaporators 10, and then directed downward as best shown in FIG. 1. However, the airflow drawn through the evaporators 10 may also be directed upward.

For example, the combination of the evaporators 10 and the air movers 12 shown in FIG. 1 may be used with marine containers (not shown) which are typically used to transport fresh produce. However, fresh produce gives off a significant amount of heat while ripening and, therefore, during transit it is desirable to control the rate of ripening. As a result of the evaporators' 10 extraction of heat and humidity from the airflow through the housings 20, the downwardly directed airflow then permits cooler and dryer air to contact the fresh produce to prolong or stabilize the rate of ripening. In the event produce in to be transported through extremely cold climates, the heater 18 may instead be operated to warm the airflow through the air mover 12 so that warmer temperatures may be maintained. Thus, the heater 18 is preferably only operated when refrigeration is not needed.

As best shown in FIG. 1, each housing 20 of the evaporators 10 includes a top 22 and a bottom 24, two sides 26 and 28, respectively, and two ends 30 and 32, respectively. The bottom 24 is preferably configured as a drain pan for condensation. Collectively, the top 22, bottom 24, sides 26 and 28, and ends 30 and 32 define an interior 34 of the housings 20. Within the interior 34 of each evaporator is a coil assembly 40 of a tubular body extending within each housing 20 for the purpose of providing a heat exchange surface. The coil assembly 40 of each evaporator 10 preferably extends in a serpentine manner the full length L and full width W of the evaporators 10. Typically, the coil assembly 40 includes a plurality of elongated segments 42 and a plurality of bent end segments 44. FIG. 1 illustrates a portion of one of the evaporators 10 cut away to show a portion of the elongated segments 42 of the coil assembly 40 oriented in a transverse manner to the airflow entering and exiting the housing 20 described in greater detail below.

A group of elongated segments 42 and bent end segments 44 are combined to form at least one coil row which extends the full length L and width W of the housing 20. However, it is common to included more than one coil row where one coil row is placed over the top of another coil row. Moreover, the elongated segments 42 and bent end segments 44 of each coil row may cross over one another such that neither of the coil rows has more of a heat load. In the present invention, however, the number of coil rows may be reduced to provide better airflow in the housing 20 without obstructions and to permit the evaporators 10 to be used in smaller spaces. As a result of the airflow through the evaporators 10 of the present invention, as described below, it is within the scope of the present invention to use only one coil row in the interior of each housing 20.

Figure 3:
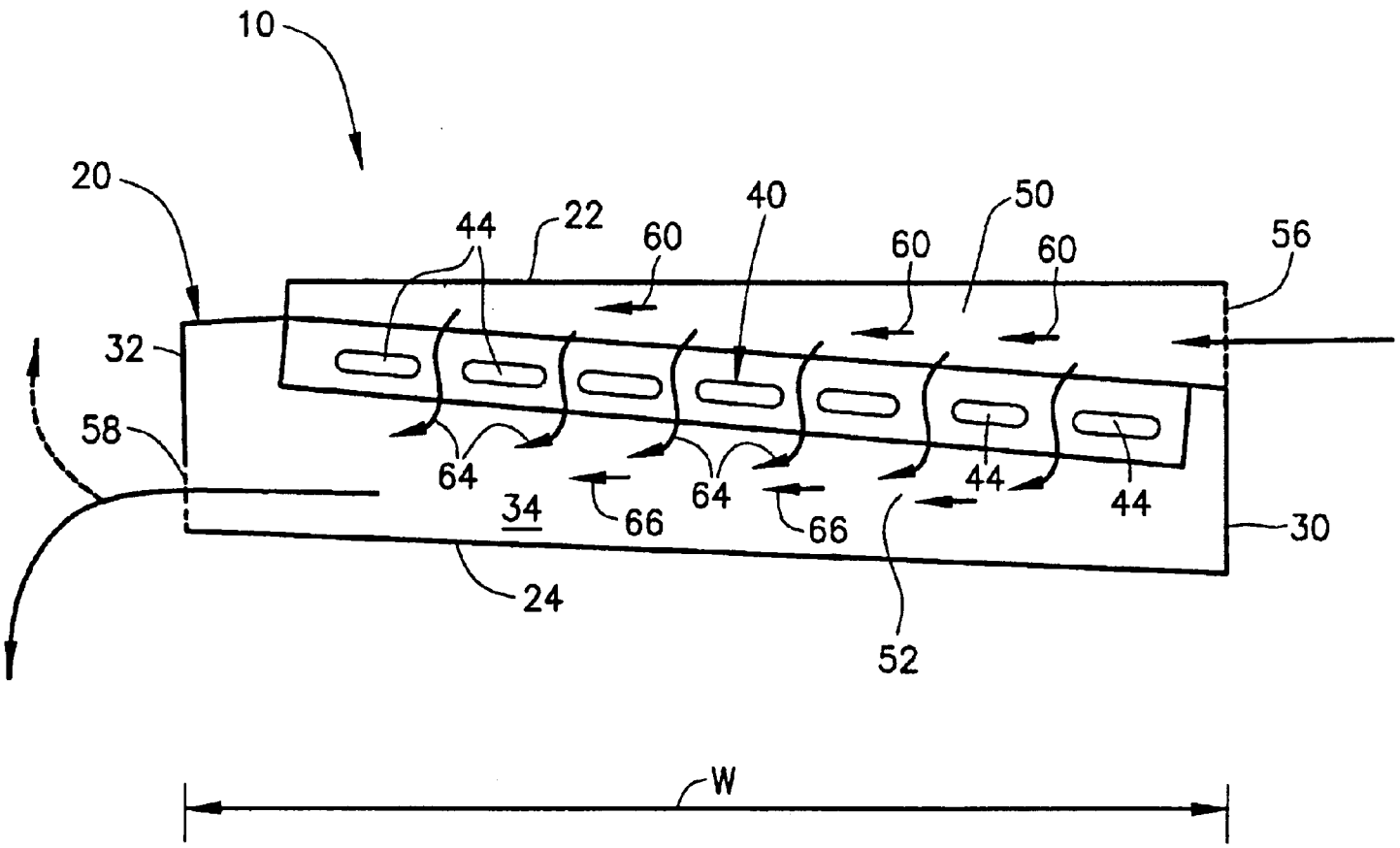
FIG. 3 illustrates a cross sectional view of the right evaporator of FIG. 2.

In the preferred embodiment of the present invention, the coil assembly is tilted within the housing 20 as best shown in FIGS. 2 and 3. In other words, the coil assembly 40 with preferably only one coil row, or possibly with more than one coil row, is angularly misaligned with the interior surface of at least one of the top 22 or bottom 24 of the housing 20. The coil assembly 40 in the housing 20 partially defines airflow plenums within the interior 34 of the housing 20. In FIG. 2, on opposite sides of the coil assembly 40 is a first airflow plenum 50 and a second airflow plenum 52. In the context of FIGS. 2 and 3, the first and second airflow plenums 50, 52 may be referred to as upper and lower airflow plenums 50, 52, respectively. Portions of the inner surfaces of the sides 26, 28 and ends 30, 32, along with either the top 22 or bottom 24, define the remaining portion of each of the airflow plenums 50 and 52. Preferably the airflow plenums 50, 52 are substantially prismatic where congruent polygons are portions of the ends 30, 32 and parallelograms are portions of the sides 26, 28. However, the present invention also contemplates non-faceted surfaces.

As shown in FIGS. 1 and 3, the end 30 has an airflow inlet 56 to permit airflow into the evaporator 10, and the end 32 has an airflow outlet 58 to permit airflow to be exhausted from the evaporator 10 and into the air mover. The inlet 56 and outlet 58 are disposed opposite one another on opposing ends of the housing 10. As best shown in FIG. 1, the inlet 56 and outlet 58 are preferably rectangular in shape and extend substantially the full length L of the evaporator 10. The inlet 56 communicates with the first airflow plenum 50 and the outlet 58 communicates with the second airflow plenum 52.

As best shown in FIG. 1, the inlet 56 in the end 30 of the right evaporator 10 is defined by the edges of the top 22, the two sides 26 and 28, and an upper edge of the end 30. Preferably, the outlet 58 is similarly defined by the two sides 26 and 28, end 32 and the bottom 24. Preferably, in order to direct the airflow into the first plenum 50 from the exterior, the inlet 56 on the end 30 is positioned closer to the top 22 than the bottom 24 and, in order to exhaust the airflow from the second airflow plenum 52, the outlet 58 on the end 32 is positioned closer to the bottom 24 than the top 22. Referring to FIG. 3, it can be seen that the inlet 56 and outlet 58 are substantially diagonally disposed to one another.

FIG. 3 also best depicts the changing cross section of the airflow plenums 50, 52. The cross-sectional area of the top airflow plenum 50 diminishes as airflow is distributed from the inlet 56 and the cross-sectional area of the bottom airflow plenum 52 increases as the airflow is distributed over the coil assembly 40 toward the outlet 58. The diminishing cross-sectional area of the top airflow plenum 50 helps to force airflow through the coil assembly as described below.

The present invention also includes a path of multi-directional airflow through the housing 20. The airflow path includes a first portion 60 that begins at end 30 and extends through the first airflow plenum 50 in a first direction. The first portion 60 is a cross flow that is distributed over a portion of the coil assembly 40. As shown in FIG. 3, the airflow in the first airflow plenum 50 is distributed across the upper surface of the coil assembly 40. The airflow path also includes a second portion 64 defining a flow extending in a second direction through the coil assembly 40. The second portion 64 of the airflow path begins in the top airflow plenum 50 and ends in the bottom airflow plenum 52. Fins typically included on the tubular body of the coil assembly 40 may assist in directing the airflow into the second direction. Although the second portion 64 of the airflow path as shown in FIG. 3 is directed downward, the second portion 64 is commonly referred to as a vertical portion of airflow. The airflow path also includes a third portion 66 which extends through the bottom airflow plenum 52 in the first direction to the opposite end 32 of the housing 20. The third portion 66 of the airflow path is a second cross flow that is distributed over a portion of the coil assembly 40 through the second airflow plenum 52. As shown in FIG. 3, the airflow is the second airflow plenum 52 is distributed across the underside of the coil assembly 40. Both the first and third portions 60, 66 of the airflow path are commonly referred to as horizontal portions of airflow. Preferably, the horizontal portions of airflow pass over the elongated segments 42 of the coil assembly 40 in substantially a transverse manner.

Figure 4:
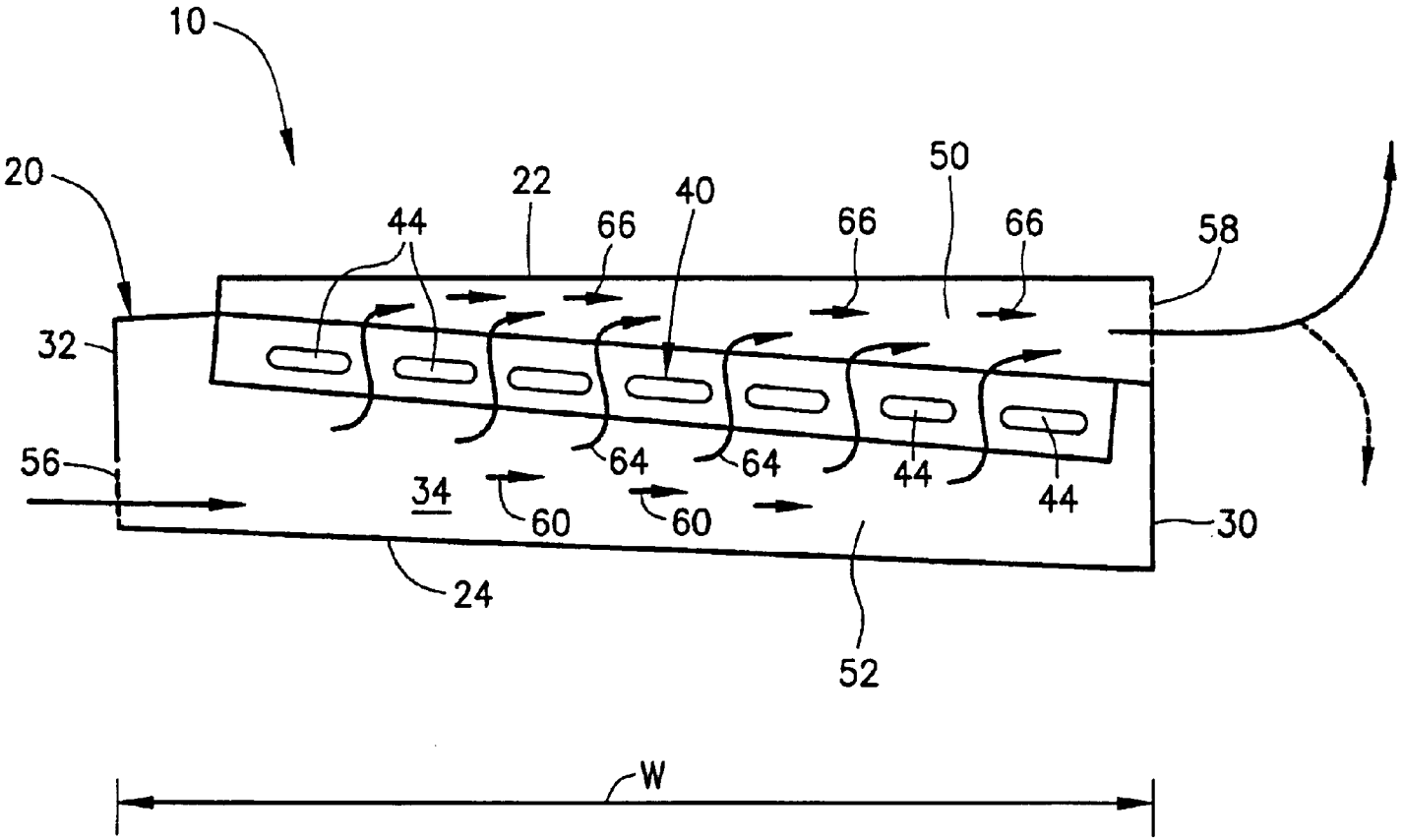
FIG. 4 illustrates a cross-sectional view of the right evaporator of FIG. 2 with reversed airflow.

Alternatively, the airflow may be reversed through the evaporator 10 as shown in FIG. 4. In such case, preferably the inlet 56 is near bottom 24 on end 32 and the outlet 58 is near the top 22 on end 30. Also, in this embodiment, the bottom airflow plenum 52 and the top airflow plenum 50 are referred to as the first and second airflow plenums, respectively. Otherwise, evaporator 10 in FIG. 3 is substantially structurally the same as the evaporator 10 of FIG. 4. In FIG. 4, the first portion 60 of the path of airflow begins at end 32 and extends through the airflow plenum 52 in a first direction. In this case, the first direction is oriented differently than in FIG. 3. The first portion 60 is a cross flow distributed across the bottom surface of the coil assembly 40. The reversed airflow also includes a second portion 64 in a second direction through the coil assembly 40. The reversed airflow also includes a third portion 66 which extends through the air plenum 50 in the first direction to the end 30 of the housing 20. The third portion 66 is a second cross flow distributed over the top surface of the coil assembly 40.

In either embodiment, the airflow in the first direction and the airflow in the second direction are preferably substantially perpendicular to one another. Thus, the coil assembly 40 within the housing 20 is oriented in an angular manner relative the airflow from the inlet 56 in the first direction as well as the airflow toward the outlet 58 in the first direction. The coil assembly 40 is also oriented in an angular manner relative the airflow in the second direction. The angular orientation of the coil assembly 40 is preferred in order to facilitate airflow through the coil assembly 40 and to place the heat load over a wider surface of the coil assembly 40 so that the heat is equally absorbed over the entire surface of the coil assembly 40.

The use of the evaporator 10 as described above constitutes an inventive method of the present invention in addition to the evaporator 10 itself. In practicing the method of the present invention for transferring heat, the steps include receiving airflow into a first airflow plenum 50 as described above. The method then includes distributing the airflow in the first airflow plenum 50 across a portion of the coil assembly 40 in a first direction. The method also includes passing the airflow through the coil assembly 40. The method then includes the step of distributing the airflow in the second airflow plenum 52 across a portion of the coil assembly 40 in the first direction. Next, the airflow is exhausted from the second airflow plenum 52 to the exterior of the housing 20. The method of the present invention may also include the step of passing airflow through the heat exchanger 10 without passing refrigerant through the heat exchanger 10 to cool the airflow. In such case, the airflow from the heat exchanger 10 is then warmed such that warm airflow may be provided when warmer temperatures are desired in colder climates or as the process might require.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. A refrigeration system comprising, in combination:

at least a pair of air movers coupled to one another, the pair of air movers configured to direct an airflow from a second airflow plenum in a direction substantially perpendicular to a first direction;

at least a pair of evaporators coupled to said pair of air movers, one of said evaporators positioned on one side of said pair of air movers and another of said evaporators positioned on an opposite side of said pair of air movers, said pair of air movers oriented relative to said pair of evaporators to draw the airflow through said pair of evaporators, and each said evaporator comprising a housing for enclosing a coil assembly therein, said coil assembly tilted in an interior within said housing;

said coil assembly partially defining in said housing on opposite sides of said coil assembly a first airflow plenum and the second airflow plenum; and a path of multi-directional airflow through said housing, said path of airflow comprising a first portion defining a cross flow distributed over a portion of said coil assembly beginning at one end of said housing and extending through said first airflow plenum in said first direction, a second portion defining a flow extending from said first airflow plenum in a second direction through said coil assembly, and a third portion defining a second cross flow distributed over a portion of said coil assembly through said second airflow plenum in said first direction to an opposite end of said housing.

2. The refrigeration system of claim 1 wherein said coil assembly comprises a plurality of elongated segments and a plurality of bent end segments, said elongated segments and said bent segments combined with one another to define a substantially serpentine-shaped coil, and said elongated segments in said interior of said housing oriented in substantially a transverse manner relative to said portions of airflow in said first direction.

3. The refrigeration system of claim 1 wherein said coil assembly is oriented within said housing in an angular manner relative to said first direction.

4. The refrigeration system of claim 1 wherein said coil assembly is oriented within said housing in an angular manner relative to said second direction.

5. The refrigeration system of claim 1 wherein said coil assembly is tilted within an interior of said housing such that said coil assembly is angularly misaligned with at least one of a top and bottom of said housing.

6. The refrigeration system of claim 5 wherein said coil assembly is angularly misaligned with both said top and bottom of said housing.

7. The refrigeration system of claim 5 wherein said coil assembly comprises a plurality of elongated segments and a plurality of bent end segments defining a single coil row extending through said housing, and wherein said interior is otherwise free of any other said coil rows in said housing.

8. The refrigeration system of claim 1 wherein said housing comprises a top and bottom, two sides and two ends, for defining an interior, one of said ends at least partially defining an airflow inlet and the other of said ends at least partially defining an airflow outlet.

9. The refrigeration system of claim 1 wherein an inlet communicates with said first airflow plenum and said second airflow plenum communicates with an outlet.

10. The refrigeration system of claim 9 wherein said inlet and outlet are substantially rectangular in shape.

11. The refrigeration system of claim 9 wherein said inlet and said outlet are substantially diagonal disposed in said housing relative to each other.

12. The refrigeration system of claim 9 wherein said inlet and said outlet are disposed opposite one another on opposing ends of said housing.

13. The refrigeration system of claim 9 wherein said inlet and said outlet each extend substantially a length of said housing.

14. The refrigeration system of claim 9 wherein said inlet is oriented closer to a top than a bottom of said housing and said outlet is oriented closer to said bottom than said top of said housing.

15. The refrigeration system of claim 1 wherein said airflow in said first direction and said airflow in said second direction are substantially perpendicular to one another.

16. The refrigeration system of claim 1 wherein said airflow in said first direction defines a pair of horizontal portions of airflow and said airflow in said second direction defines a vertical portion of airflow.

17. A system, comprising:

a first housing adapted to enclose a first coil assembly, the first coil assembly tilted in a first interior of the first housing, the first coil assembly partially defining in the first housing on opposite sides of the first coil assembly a first airflow plenum and a second airflow plenum;

a second housing adapted to enclose a second coil assembly, the second coil assembly tilted in a second interior of the second housing, the second coil assembly partially defining in the second housing on opposite sides of the second coil assembly a third airflow plenum and a fourth airflow plenum; and at least one air mover situated with the first housing on one side and the second housing on an opposite side, the at least one air mover configured to draw a first airflow through the first housing in a first direction and a second airflow through the second housing in a second direction opposite the first direction, the at least one air mover direct the first airflow from the second airflow plenum and the second airflow from the fourth airflow plenum in a third direction substantially perpendicular to the first direction.

18. The system of claim 17 wherein said coil assemblies are oriented within said respective housings in an angular manner relative to said first direction.

19. The system of claim 17 wherein said airflow plenums are substantially prismatic.

20. The system of claim 17 wherein a cross-sectional area of said first airflow plenum diminishes as said air flow is distributed from an inlet and the cross-sectional area of said second airflow plenum increases as said airflow is distributed over said first coil assembly toward an outlet.

21. The system of claim 17, wherein said at least one air mover is arranged so that air is first drawn through the housings, through said at least one air mover, and then directed downward.

22. The system of claim 17, wherein said at least one air mover is arranged so that air is first drawn through the housings, through said at least one air mover, and then directed upward.

* * * * *